US005409575A

United States Patent [19]

Savia et al.

[11] Patent Number: 5,409,575

[45] Date of Patent: Apr. 25, 1995

[54] TWO-WIRE WEB-FORMING SECTION OF A PAPER MACHINE

[75] Inventors: Risto Savia, Lappeenranta; Ilkka Jääskeläinen, Nattari; Kari Salminen, Ylöjärvi, all of Finland

[73] Assignee: Valmet-Tampella Inc., Tampere, Finland

[21] Appl. No.: 30,057

[22] PCT Filed: Jul. 20, 1992

[86] PCT No.: PCT/FI92/00219

§ 371 Date: Mar. 19, 1993

§ 102(e) Date: Mar. 19, 1993

[87] PCT Pub. No.: WO93/02250

PCT Pub. Date: Feb. 4, 1993

[30] Foreign Application Priority Data

Jul. 19, 1991 [FI] Finland ..... 913480

[51] Int. Cl.[6] ..... D21F 1/00

[52] U.S. Cl. ..... 162/301; 162/203; 162/212; 162/213; 162/292; 162/315

[58] Field of Search ..... 162/203, 212–214, 162/301, 315, 317, 292

[56] References Cited

U.S. PATENT DOCUMENTS

| | | | |
|---|---|---|---|
| 3,578,558 | 5/1971 | McCarrick et al. | 162/301 |
| 3,726,758 | 4/1973 | Parker et al. | 162/317 |
| 3,944,464 | 3/1976 | Means | 162/301 |
| 4,125,428 | 11/1978 | Phelps | 162/301 |
| 4,609,435 | 9/1986 | Tissari | 162/352 |
| 4,790,909 | 12/1988 | Harwood | 162/301 |
| 5,141,600 | 8/1992 | Meinecke et al. | 162/301 |

FOREIGN PATENT DOCUMENTS

| | | | |
|---|---|---|---|
| 50647 | 2/1976 | Finland . | |
| 77702 | 12/1988 | Finland . | |
| 83102 | 2/1991 | Finland . | |
| 2113014 | 9/1972 | Germany . | |
| 91/02842 | 3/1991 | WIPO | 162/301 |

*Primary Examiner*—Karen M. Hastings
*Attorney, Agent, or Firm*—Pollock, Vande Sande & Priddy

[57] ABSTRACT

A two-wire web-forming section for a paper machine includes two wire loops, consisting of a first wire (1) and a second wire (2), water draining therethrough from a web (W) to be formed in two directions within a two-wire dewatering zone established by the wires. A breast roll (4) guiding first wire (1) is open and a constricted slice jet (S) comes into contact with first wire (1) within the contact area of open roll (4) and with second wire (2) downstream of breast roll (5) guiding it. The distance (l) of wire (1) lying on open breast roll (4) at the diverging point of the first wire and breast roll (4) from said second wire (2) lying straight between its own breast roll (5) and the guide element (6) guiding the wires together is less, preferably 1–4 mm less than the thickness of the constricted slice jet (S).

14 Claims, 2 Drawing Sheets

TWO-WIRE WEB-FORMING SECTION OF A PAPER MACHINE

FIELD OF THE INVENTION

The present invention relates to a two-wire web-forming section in a paper machine.

BACKGROUND OF THE INVENTION

Two-wire web formers (gap formers) are generally divided in two basic types, namely roll gap formers and blade gap formers.

In a roll gap former, the pulp stock is delivered from a head box into a gap formed by a forming roll and two wires, whereafter the wires and the pulp stock therebetween follow the curvature of a forming roll for removing most of the water through the wires. The necessary dewatering pressure is provided by the tautness of an outer wire for generating in the stock a pressure which is directly proportional to the wire tautness and inversely proportional to the radius of curvature of the forming roll. In the gap, some of the kinetic energy of a jet coming from the head box converts into pressure energy and the jet speed is reduced accordingly. Dewatering away from the forming roll is intensified by centrifugal force. Towards the forming roll, dewatering can be intensified by means of vacuum. In this case, the forming roll must be constructed as a vacuum roll.

Typically of a roll gap former, the produced paper has a rather poor formation (a small-scale surface weight dispersion) and a good retention or the ratio of the amount of solids retained in a web to be formed to the amount of solids discharged from the head box.

The other basic design of a two-wire former is a so-called blade gap former which is characterized in that a slice jet discharging from the head box is delivered into a gap which is formed by two wires and converges either into a substantially straight-lined dewatering zone, formed by means of dewatering blades located on either side of the wires transversely to the traveling direction of the wires, or into one or two successive curved dewatering zones, wherein the blades are located towards the center of curvature of the wires. This type of formers are disclosed, for example, in U.S. Pat. No. 3,578,558, German Publication print 21 13 014, U.S. Pat. No. 3,944,464 and U.S. Pat. No. 4,125,428, and Finnish 1.0 Publication print 50647.

In turn, a blade gap former has typically a good formation and a low retention.

The above basic types can be combined, for example, in such a manner that the forming zone commences as a roll gap former and continues as a former, in which the blades are positioned the same way as in a blade gap former, whereby its qualities are determined on the basis of the relative proportion of the above-described dewatering techniques. This type of solutions are disclosed, for example, in Finnish Publication print 83102 and Finnish Patent 77702. Despite the efforts of combining these former types, the poor qualities of both basic types shall partially remain.

An object of this invention is to introduce a two-wire web former which does not possess the above-described drawbacks found in the basic types. The invention is capable of providing a gap supported by an open breast roll, wherein the dewatering is nevertheless not excessive prior to location of a guide element converging the wires at which the-dewatering is allowed to continue. This is of major importance especially for improving of the formation.

BRIEF DESCRIPTION OF THE DRAWINGS

The invention will now be described in more detail with reference made to the accompanying drawings, in which.

DETAILED DESCRIPTION OF THE PREFERRED EMBODIMENT

Figure 1:
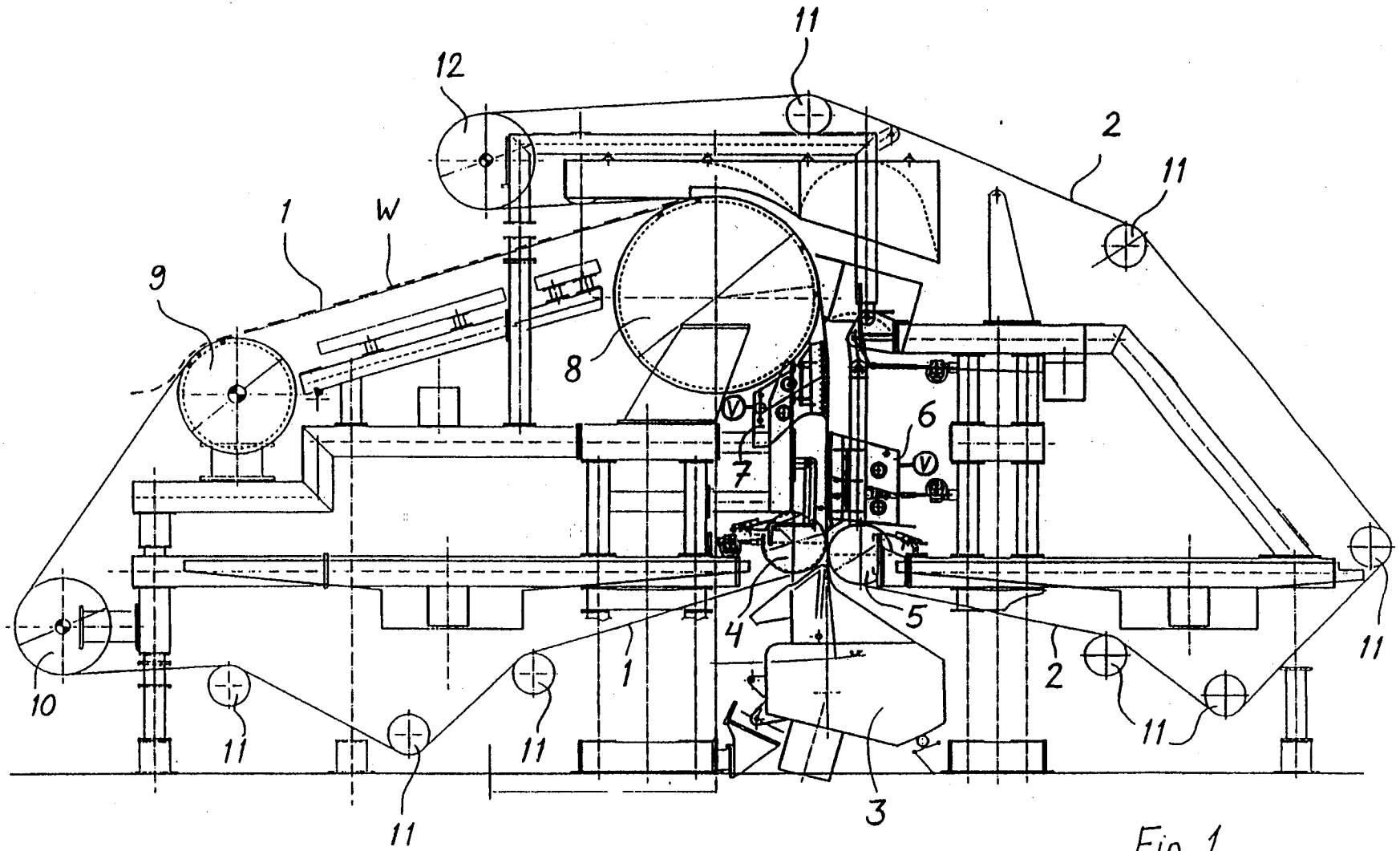
FIG. 1 shows a two-wire papermaking machine in a side view.

FIG. 1 is a schematic view, showing the components most essential for the operation of a web former of the present invention, including a first wire loop 1, a second wire loop 2, a head box 3, an open breast roll 4, a breast roll 5 which can be a smooth breast roll, a first dewatering box 6, a second dewatering box 7, a forming roll 8, a suction roll 9, a first-wire drive roll 10, wire-leading rolls 11, and a second-wire drive roll 12.

The first wire 1 and the second wire 2 are both guided by the above-mentioned rolls to produce an endless loop. The loops join each other for a two-wire dewatering zone through the guidance of breast rolls 4, 5 and first dewatering box 6 and diverge at forming roll 8.

The open breast roll 4 is constructed with surface cavities in such a manner that dewatering can occur through first wire 1 as the first wire 1 is following the surface of the open breast roll.

The first dewatering box 6 is provided with a curved surface, comprising blades 6*a* (shown in FIG. 2) set transversely to the running direction of the wires and having its center of curvature on the side of second wire 2. The radius of curvature can be constant within the box area or it can diminish either in a stepped or stepless fashion in the advancing direction of the wires. The blades, which in contact with second wire 2 guide first the second wire 2 and then, downstream of the conjunction point of the wires, both wires as well as a web W therebetween along a track curving as described above, are spaced from each other in such a manner that the water escaped through the wire is allowed to flow inside the box. The box can be linked to a vacuum device V so as to achieve dewatering inside the box as well as a vacuum intensifying the shearing forces produced by the blades. The box may comprise a single unitary chamber or it can be divided in two or more sequentially arranged chambers in the advancing direction of the wires.

The second dewatering box 7 is located downstream of the first dewatering box 6 and is designed as described above except that its center of curvature is on the side of first wire 1 and its radius of curvature is smaller than that of the first box 6. In case the radii of curvature of the boxes diminish in the running direction of the wires, the average radius of curvature of the surface of second box 7 guiding the wires will be less than that of the corresponding surface of first box 6. The blades of box 7 are in contact with first wire 1 and guide the wires and the web W along a track curved as described above. Also this box can be connected to vacuum device V.

The forming roll 8 downstream of the boxes is a suction roll which is provided with one or more, preferably three suction chambers. At suction roll 8, the first wire 1 and web W disengage from second wire 2 and advance towards a press section.

Figure 2:
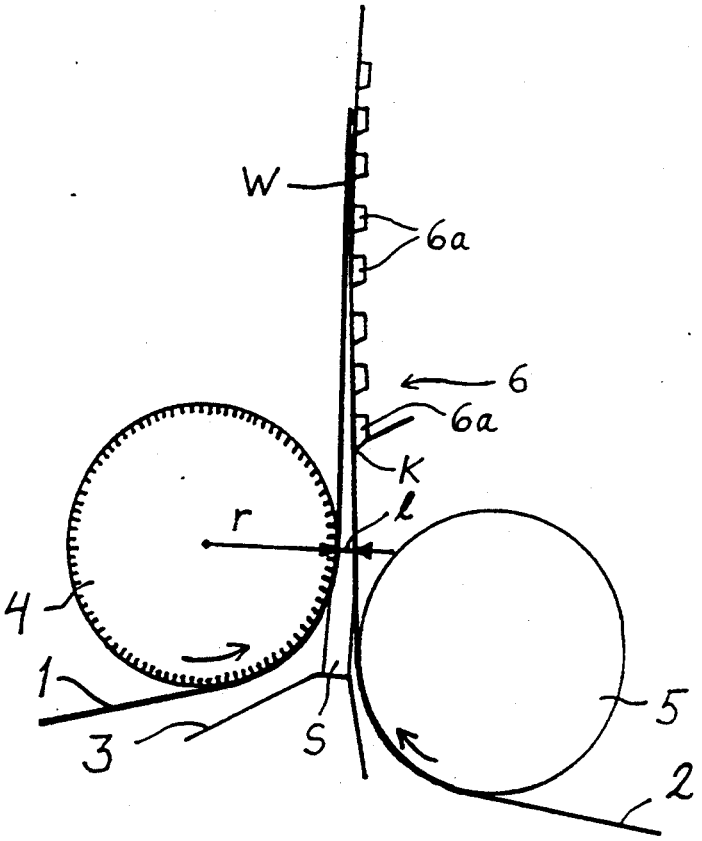
FIG. 2 shows the initial section in the dewatering zone of a papermaking machine, a so-called gap, in a larger scale.

FIG. 2 illustrates in more detail a dewatering zone commencing at breast rolls 4 and 5. A slice jet S discharging from head box 3 is directed into a gap between first wire 1 and second wire 2, the gap being formed by positioning breast rolls 4 and 5 as well as dewatering box 6 such that the distance of the first wire 1 lying on open breast roll 4 at the diverging point of the first wire and breast roll 4 from the second wire lying straight between its own breast roll 5 and the guide surface of dewatering box 6 is 1–4 mm smaller than the thickness of the constricted slice jet S issuing from head box 3. This distance 1 has been measured perpendicularly to the plane which is equidistant from wires 1 and 2 lying straight between the breast roll and the dewatering box and-that distance can be termed as "gap dimension" The gap dimension is on the one hand, determined by the position of the breast roll 5 of second wire 2 relative to the guide surface of dewatering box 6, which determines the position of second wire 2 between the diverging line of the wire and the surface and, on the other hand, by the position of the breast roll 4 of first wire 1 relative to the surface of the same dewatering box, which determines the position of wire 1 between the wire-diverging line and the surface. The smooth breast roll 5 is located such that the slice jet S comes into contact with second wire 2 over the free section remaining between breast roll 5 and first dewatering box 6.

In FIG. 2, a wire in contact with the surface of first dewatering box 6 is the second wire but the dewatering box guide surface can also be located on the side of first wire 1, which is thus in contact with the guide surface. Even in this case, the gap dimension 1 is determined as a distance of the point of divergence of first wire 1 from the second wire 2 lying straight between the breast roll 5 and the guide surface of dewatering box 6, whereby the second wire is guided by the guide surface of the dewatering box and comes into contact with the first wire 1 lying on top of dewatering box 6 as well as with web W.

As shown in FIG. 2, the slice of head box 3 is further directed such that the slice jet S hits simultaneously both wires 1, 2 upstream of the determining point of gap dimension 1. Since the open breast roll 4 curves the first wire 1 to a greater angle towards the opening direction of the gap, the slice jet S can be directed more towards second wire 2 relative to the straight wire sections between breast rolls and dewatering box. However, the jet is well capable of filling the gap as it hits the curved section of first wire 1 lying at a greater angle, provided by breast roll 4.

The breast roll 4 guiding the first wire 1 is provided with an open surface and, thus, it can be slotted or bored or otherwise provided with an open surface, whereby water can escape from slice jet S into the open spots of the surface already at that point of a dewatering zone where the slice jet sweeps the surface of wire 1 running on top of breast roll 4. The smooth breast roll 5 guiding the second wire 2 does not participate in dewatering and the point of divergence of wire 2 therefrom is located upstream of where the slice jet hits the wire.

The above-described disposition of machine elements can be used for setting the dewatering pressure of the gap by varying gap dimension 1 within the above range to be as desired and, thus, it is possible to affect the amount of dewatering within the gap area. This is of essential importance in view of the qualities, particularly the formation of web to be formed. The present invention can be used to avoid a substantial removal of water upstream of first dewatering box 6, which removal, with both wires running in a certain sector on a forming roll, would be defined by a formula $p=T/R$, wherein p is drainage pressure, T is the tautness of an outer wire, and R is the radius of a forming roll. If major dewatering were to occur within the gap area, the pulp stock between the wires would have such a high consistency that the formation-improving effect of curved-surface, blade-equipped dewatering boxes would remain unattained. In addition, a powerful dewatering within the gap area would carry fine matter in the stock layer towards the wires whereby, within the mid-section in the direction of web thickness, there would be a layer with a poor fine matter content and, as a result of this, the internal bond strength of a finished web would remain low. The amount of water escaping from pulp stock upstream of the guide surface of dewatering box 6 is preferably no more than 20%. Thus, in a gap gradually converging within the area of dewatering box 6, it is possible to work on the web at a relatively high water content.

Thus, the disposition of the present invention is capable of providing a long gap, having a low drainage pressure but in which the open breast roll 4 nevertheless contributes to dewatering without arching or curving the run of both wires. Thus, water escapes at a uniform rate from the gap prior to the pressing of the web W between the wires by means of the surface of first dewatering box 6 guiding the wires. FIG. 2 illustrates how the second wire 2 comes into contact with a guide surface formed by blades 6*a* included in dewatering box 6 already at the first blade 6*a* (point K) located at the forward edge of the box. At the same time, the water removed before the dewatering box 6 through wire 2 is deflected by the forward blade edge away from the back surface of the wire. The converging gap continues within the of by said dewatering box and the first wire 1 is guided by the guide surface of the box to settle on top of wire 2 at a later stage, that is the aqueous web under formation gradually thinning towards the rear end of the gap separates wires 1 and 2 from each other over the forward section of the dewatering box.

In order that the free slice jet S between the slice of head box 3 and the gap would be as short as possible, it is preferred that the periphery of open breast roll 4 be sharply curved away from the gap in order to fit in the head box 3 near the forward end of the gap. Thus, the radius of breast roll 4 is preferably less than 75 cm. The length of free slice jet S prior to where it hits wires 1, 2 is preferably less than 300 mm.

In terms of both formation and fine-matter and filler distributions in the thickness direction it is important to control the shearing forces applied to each side of a web and the direction of dewatering over the length of an entire forming area. Therefore, it is important that blade-equipped dewatering boxes 6, 7 having curved surfaces are positioned on different sides along the common run of wires 1, 2. The shearing forces and the distribution of dewatering through each wire can be affected not only by the strength of vacuums of the dewatering elements, but also by selecting suitable radii of curvature for the dewatering boxes as well as blade spacings and widths most suitable for any given situation. The guide surface of first dewatering box 6 has a relatively large radius of curvature or its average, which is preferably more than 500 cm. The corresponding radius of second box 7 is smaller than that of the first box.

The forming roll 8 shown in FIG. 1 downstream of dewatering boxes 6 and 7 is a roll with a large radius. Although it is located in FIG. 1 inside the loop of first wire 1, an alternative is to place it inside the loop of second wire 2, whereby the web W remains with second wire 2.

The direction of the gap receiving the slice jet and formed by wires 1 and 2 is preferably in horizontal plane or directed upwards, in other words at an angle of 0°–90° relative to horizontal plane. The entire forming section extends preferably in vertical direction, whereby the gap direction can be upwards from horizontal plane at an angle of more than 60°.

We claim:

1. A two-wire web-forming section for a paper machine comprising:

two wire loops including a first wire and a second wire, a two-wire dewatering zone for draining water from a web (W) to be formed therethrough in two directions, said two-wire dewatering zone being formed by a first breast roll located within the first wire, a second breast roll located upstream of the first breast roll and within the second wire, and by a guide element located within the second wire downstream of said first and second breast rolls, the first and second wires forming a converging gap, the second wire traveling in a straight path between said second breast roll and said guide element, a head box structured and arranged to deliver a constricted slice jet (S) of a predetermined thickness at a point where the slice jet meets one of the wires and consisting of paper stock suspension, said guide element being located downstream of the converging gap and structured and arranged to guide said first and second wires together spaced from each other in such a manner that a spacing between said first and second wires is reduced within the area of said guide element just to a size of an aqueous web (W), and also structured and arranged to determine the gap between said breast rolls and a conjunction point and to control the common run of said wires, wherein said first breast roll guiding said first wire within a contact area before a diverging point of the first wire is open and said headbox, said first and second breast rolls, and said guide element are structured and arranged so that the constricted slice jet (S) comes into initial contact with said first wire within the contact area of said open breast roll and with the second wire within a free area between the second breast roll guiding said second wire and said guide element and upstream of the diverging point of the first wire and said open breast roll, a distance between said first wire lying on said open first breast roll and said second wire traveling straight between said second breast roll and said guide element at the diverging point of the first wire and said open first breast roll being less than the thickness of the constricted slice jet (S).

2. A web-forming section according to claim 1, wherein the second breast roll is a smooth-surfaced roll.

3. A web-forming section according to claim 1, wherein said distance is between 1 to 4 mm less than the thickness of the constricted slice jet (S).

4. A web-forming section according to claim 1, wherein said guide element is adapted, at the rear end of the gap to guide said first and second wires, for curving them in the same direction so as to converge them towards each other within the area of a curved guide surface included in said guide element separated by a gradually thinning, water-containing web being formed.

5. A web-forming section according to claim 1, wherein said guide element guides said wires to curve them in the direction of said second breast roll guiding said second wire.

6. A web-forming section according to claim 1, further including in the traveling direction of the wires after said guide element, an additional guide element, said guide elements being structured and arranged to guide the common run of said first and second wires along paths curving in opposite directions.

7. A web-forming section according to claim 6 wherein said guide elements include a first curved dewatering box having its center of curvature on the side of said second wire and a second curved dewatering box having its center of curvature on the side of said first wire.

8. A web-forming section according to claim 6 wherein the path formed by said first guide element has a radius of curvature or an average radius of curvature which exceeds the radius of curvature or the average radius of curvature of the path formed by second guide element.

9. A web-forming section according to claim 8, wherein the path formed by said first guide element has a radius of curvature or its average which is more than 500 cm.

10. A web-forming section according to claim wherein said second wire is arranged in contact with a longitudinal guide surface included in said guide element guiding said wire immediately at the forward edge (K) of said surface, said edge being adapted to deflect water escaped from the gap through said wire away from the back surface of said second wire upstream of said guide surface.

11. A web-forming section according to claim 1, wherein at least the surface of said guide element includes blades laid transversely to the traveling direction of said wires.

12. A web-forming section according to claim 1, wherein said open breast roll has a radius (r) of less than 75 cm.

13. A web-forming section according to claim 1, wherein the direction of the gap receiving the slice jet and formed by said wires extends in horizontal plane or upwards therefrom at an angle of 0°–90° relative to horizontal plane.

14. A web-forming section according to claim 1, wherein the entire two-wire forming section extends in substantially vertical direction and the direction of said gap is upwards from horizontal plane at an angle of more than 60°.

* * * * *